US009103103B1

(12) United States Patent
McCann

(10) Patent No.: US 9,103,103 B1
(45) Date of Patent: Aug. 11, 2015

(54) AUTOMATIC FLUSHING URINAL INTEGRATED WITH HAND WASHING SINK

(71) Applicant: Edward J. McCann, Ravenna, OH (US)

(72) Inventor: Edward J. McCann, Ravenna, OH (US)

( * ) Notice: Subject to any disclaimer, the term of this patent is extended or adjusted under 35 U.S.C. 154(b) by 252 days.

(21) Appl. No.: 13/874,639

(22) Filed: May 1, 2013

(51) Int. Cl.
*A47K 4/00* (2006.01)
*E03D 1/00* (2006.01)

(52) U.S. Cl.
CPC ..... *E03D 1/003* (2013.01)

(58) Field of Classification Search
USPC ..... 4/665; 700/281, 282
See application file for complete search history.

(56) References Cited

U.S. PATENT DOCUMENTS 2,595,009 A * 4/1952 Sillen ..... 4/665
2,860,348 A * 11/1958 McClenahan ..... 4/665
3,588,922 A * 6/1971 Carfora ..... 4/665
4,876,751 A 10/1989 Van Meter
5,228,152 A 7/1993 Fraley
5,522,096 A 6/1996 Brown
5,540,362 A 7/1996 Azuma et al.
5,765,242 A 6/1998 Marciano
5,862,546 A * 1/1999 Kim ..... 4/665
6,425,148 B1 7/2002 Chen
6,647,559 B2 11/2003 Lee
6,956,498 B1 10/2005 Gauthier et al.
2009/0077736 A1 3/2009 Loberger et al.

* cited by examiner

*Primary Examiner* — Lauren Crane

(57) ABSTRACT

The present invention features an automatic flushing urinal integrated with a hand washing sink. The hand washing sink is located right above the urinal with a sink drainage fluidly connected to the urinal. The urinal has a sensor located in the internal wall of the urinal to detect urine flow. When urine stops flowing, the sensor would trigger an automatic flushing to open a water valve for a predetermined period. The water valve is fluidly connected to a water spout disposed on the hand washing sink such that the water flowing from the water faucet is able to be used for hand washing first and then for urine flushing.

8 Claims, 3 Drawing Sheets

(ISO View)

(Top View)

(Side View)

(Front View)

(Block Diagram)

AUTOMATIC FLUSHING URINAL INTEGRATED WITH HAND WASHING SINK

FIELD OF THE INVENTION

The present invention relates to a urinal, and more particularly relates to an automatic flushing urinal integrated with a hand washing sink.

BACKGROUND OF THE INVENTION

A urinal is a specialized toilet for urination only and is widely used in public restrooms for male users. It can take the form of a container or simply a wall, with drainage and automatic or manual flushing after a user finishes using the urinal. Typically, the user will need to use a separate hand washing basin to wash his hands. The water usage required for a single urinal has been doubled due to both urinal flushing and hand washing. Therefore, there is a need to combine the separate urinal washing and hand washing to minimize water usage.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an automatic flushing urinal integrated with a hand washing sink. The hand washing sink is located right above the urinal with a sink drainage fluidly connected to the urinal. The urinal has a sensor located in the internal wall of the urinal to detect urine flow. When urine stops flowing, the sensor would trigger an automatic flushing to open a water valve for a predetermined period. The water valve is fluidly connected to a water spout disposed on the hand washing sink such that the water flowing from the water faucet is able to be used for hand washing first and then for urine flushing.

DESCRIPTION OF PREFERRED EMBODIMENTS

Figure 1:
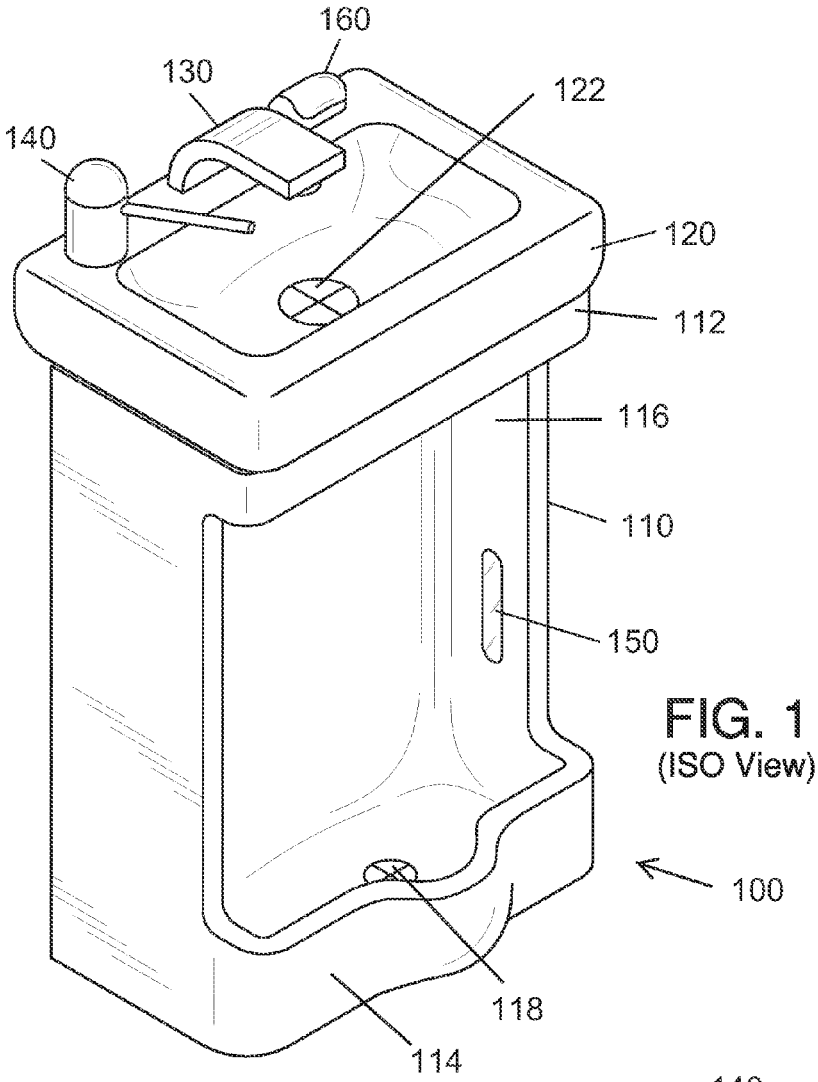
FIG. 1 shows an isometric view of the automatic flushing urinal.

Following is a list of elements corresponding to a particular element referred to herein:

100 automatic flushing urinal
110 urinal wall
112 top end of the urinal wall
114 bottom end of the urinal wall
115 indentation
116 interior surface of the urinal wall
118 drainage port of the urinal wall
120 hand washing sink

Figure 2:
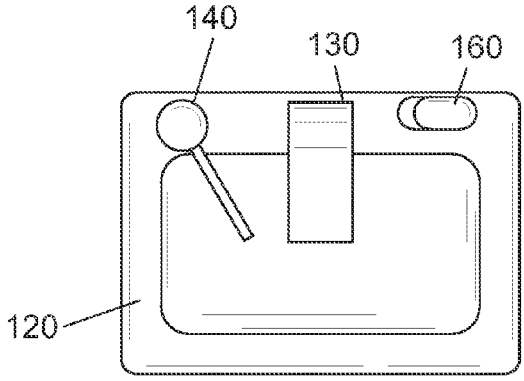
FIG. 2 shows a top view of the automatic flushing urinal.
Figure 3:
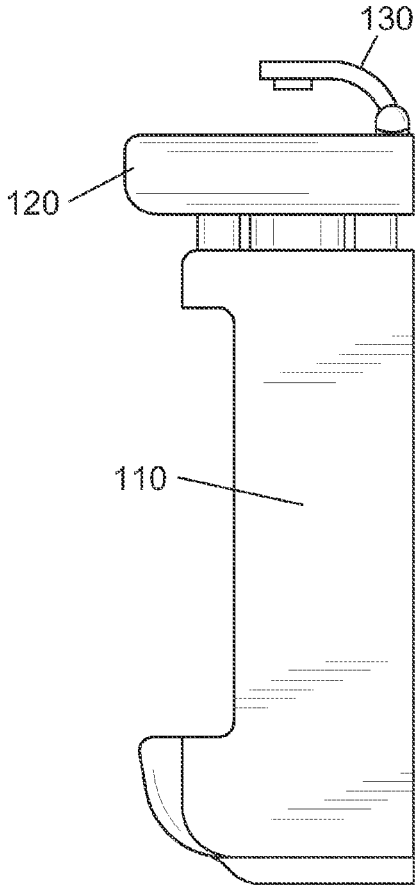
FIG. 3 shows a side view of the automatic flushing urinal.
Figure 4:
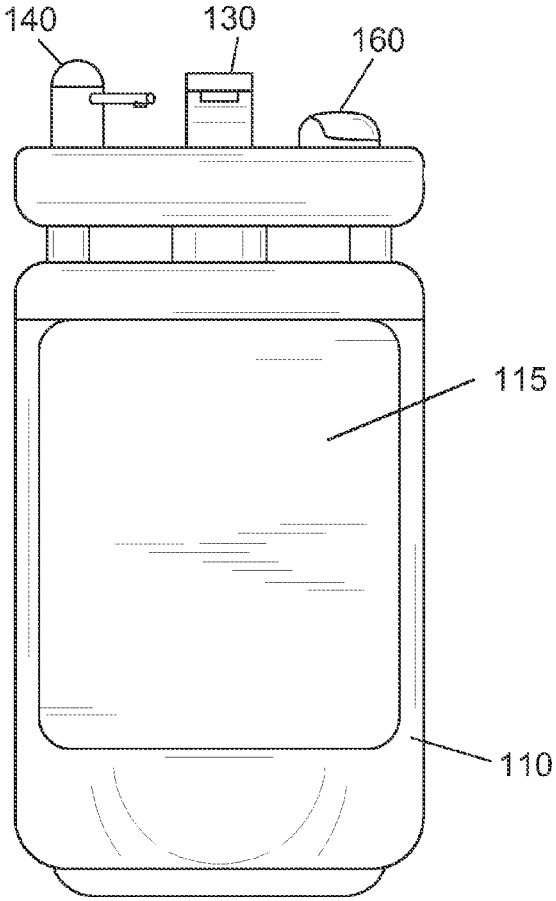
FIG. 4 shows a front view of the automatic flushing urinal.
Figure 5:
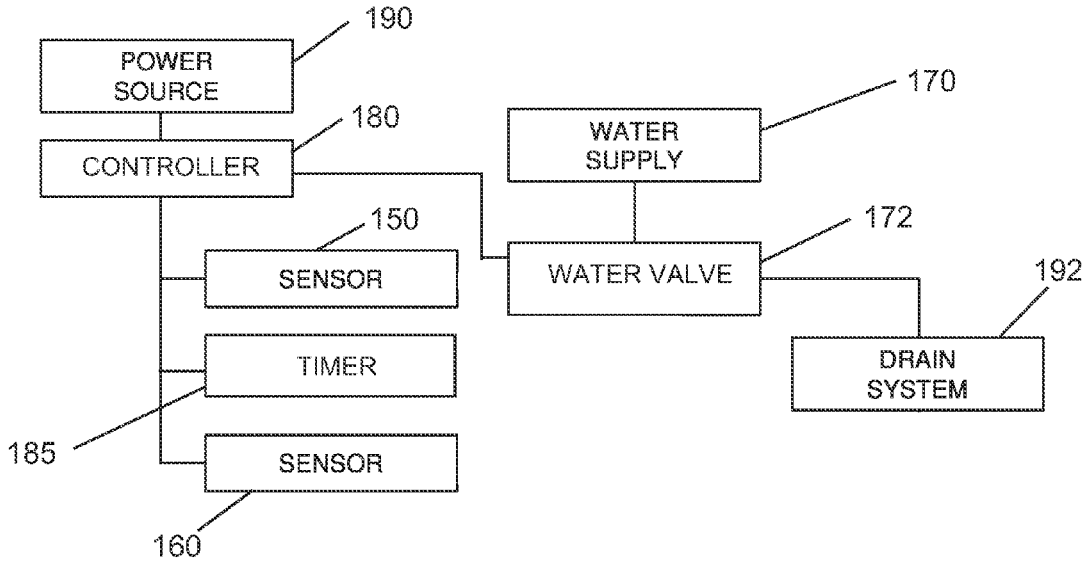
FIG. 5 shows a block diagram of the automatic flushing urinal.

122 drainage port of hand washing sink
130 water spout
140 soap dispenser
150 urine sensor
160 secondary sensor
170 water supply
172 water valve
180 controller
185 timer
190 power source
192 drain system Referring now to FIG. 1-5, the present invention features an automatic flushing urinal (100) integrated with a urinal wall (110) and a hand washing sink (120). The urinal wall (110) has a top end (112), a bottom end (114) and an indentation (115) between the top end and the bottom end. A urinal drainage port (118) is disposed on the bottom end to fluidly connect to a drain system (192).

At least one urine flow sensor (150) is directly disposed on an inner surface (116) of the urinal wall. The urine sensor functions to sense urine flow. In some embodiments, the urine sensor is a pressure sensor to sense the pressure from urine flow. In some embodiments, the urine sensor is a capacitive touch sensor to sense urine flow. Typically, urine contains a certain percentage of salt or other electrolytes, thus having some conductivity to trigger a capacitive touch sensor.

The hand washing sink (120) is disposed above the top end (112) of the urinal wall (110). The hand washing sink (120) has a sink drainage port (122) fluidly connected to the urinal wall indentation (115). A water spout (130) is disposed on the hand washing sink (120) for water flow outlet into the hand washing sink (120).

The automatic flushing urinal (100) also comprises a controller (180), a timer (185), a power source (190) and a water valve (172). The water valve (172) is fluidly connected to a water supply (170). The controller (180) is operatively connected to the water valve (172), the timer (185), the power source (190) and the urine flow sensor (150). In some embodiments, the urine flow sensor (150) gets activated when it detects urine flow. When urine stops flowing, the urine flow sensor (150) sends a first signal to the controller (180). Whereupon receiving the first signal, the controller (180) sends a second signal to the water valve (172) to allow water flow from the water supply (170) through the water valve (172) and water spout (130). Whereupon receiving the first signal, the controller (180) sends a third signal to the timer (185) to start time counting. The timer (185) sends back to the controller (180) a fourth signal after a first pre-determined period. Whereupon receiving the fourth signal, the controller (180) sends a fifth signal to the water valve (172) to close the valve and stop water flow.

In some embodiments, the controller (180) is a logic control circuit. In some embodiments, the controller (180) is a microprocessor module. In some embodiments, the controller (180) comprises a memory component to store a software control code.

In some embodiments, the power source (190) is a battery, a utility power line. The battery could be a rechargeable battery recharged by a motion charger driven by water flow when the water valve (172) is open.

In some embodiments, the first pre-determined period is a fixed value, such as 10 seconds, 20 seconds, 30 seconds, 1 minute, 2 minutes, etc. In some embodiments, the pre-determined period is a variable value determined by the time of the urine flow that the urine flow sensor detected.

In some embodiments, the urine flow sensor (150) is a strip running the entire inside length or height of the interior surface (116) of the urinal wall (110) such that the urine flow sensor (150) does not miss detecting any urine flow.

In some embodiments, the hand washing sink further comprises a hand soap dispenser (140) to dispense hand soap. Hand soap dispensers are well known to one of ordinary skill in the field.

In some embodiments, the hand washing sink further comprises a secondary sensor (160). The secondary sensor (160) is operatively connected to the controller (180) and the timer (185). In some embodiments, the secondary sensor (160) is a motion detect sensor, such as a passive infrared sensor, to detect hand motion.

The secondary sensor (160) is activated when it detects hand motion and sends a sixth signal to the controller (180). Whereupon receiving the sixth signal, the controller (180) sends a seventh signal to the water valve (172) to allow water flow from the water supply (170) through the water valve (172) and water spout (130). Whereupon receiving the sixth signal, the controller (180) sends an eighth signal to the timer (185) to start time counting. The times (185) sends back to the controller (180) a ninth signal after a second pre-determined period. Whereupon receiving the ninth signal, the controller (180) sends a tenth signal to the water valve (172) to close the valve and stop water flow. The secondary sensor (160) provides an extra means for a user to wash his/her hands when the user just wants to wash his/her hands only.

In some embodiments, the secondary sensor (160) hibernates when the urine flow sensor (150) detects urine flow to prevent unexpected water flow when a user is using the urinal.

In some embodiments, the second pre-determined period is a fixed value of 10 seconds, 20 seconds, 30 seconds, 1 minute or 2 minutes.

The automatic flushing urinal has varied size to accommodate usage for adult and kids. In some embodiments, the automatic flushing urinal has a bottom end (114) 0.5 foot above ground. In some embodiments, the automatic flushing urinal has a bottom end (114) 1 feet above ground. In some embodiments, the automatic flushing urinal has a bottom end (114) 2 feet above around.

The disclosures of the following U.S. Patents are incorporated in their entirety by reference herein: (1) U.S. Pat. No. 3,588,922, (2) U.S. Pat. No. 4,876,751, (3) U.S. Pat. No. 5,228,152, (4) U.S. Pat. No. 5,522,096, (5) U.S. Pat. No. 5,540,362, (6) U.S. Pat. No. 5,765,242, (7) U.S. Pat. No. 6,425,148, (8) U.S. Pat. No. 6,956,495 and (9) U.S. Patent Application Publication 2009/0077736A1.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. An automatic flushing urinal (100) comprising:

(a) a urinal wall (110) with a top end (112), a bottom end (114) and an indentation (115) between the top end and the bottom end, wherein a urinal drainage port (118) is disposed on the bottom end to fluidly connect to a drain system (192);

(b) at least one urine flow sensor (150) directly disposed on an inner surface (116) of the urinal wall (110), wherein the urine sensor functions to sense urine flow;

(c) a hand washing sink (120) disposed above the top end (112) of the urinal wall (110), wherein the hand washing sink (120) has a sink drainage port (122) fluidly connected to the urinal wall indentation (115), wherein a water spout (130) is disposed on the hand washing sink (120) for water flow outlet into the hand washing sink (120); and (d) a controller (180), a timer (185), a power source (190) and a water valve (172); wherein the water valve (172) is fluidly connected to a water supply (170), wherein the controller (180) is operatively connected to the water valve (172), the timer (185), the power source (190) and the urine flow sensor (150);

wherein the urine flow sensor (150) gets activated when it detects urine flow, wherein when urine stops flowing, the urine flow sensor (150) sends a first signal to the controller (180), whereupon receiving the first signal, the controller (180) sends a second signal to the water valve (172) to allow water flow from the water supply (170) through the water valve (172) and water spout (130); whereupon receiving the first signal, the controller (180) sends a third signal to the timer (185) to start time counting, the timer (185) sends back to the controller (180) a fourth signal after a first pre-determined period; whereupon receiving the fourth signal, the controller (180) sends a fifth signal to the water valve (172) to close the valve and stop water flow.

2. The automatic flushing urinal (100) of claim 1, wherein the urine flow sensor (150) is a strip running the entire inside length or height of the interior surface (116) of the urinal wall (110) such that the urine flow sensor (150) does not miss detecting any urine flow.

3. The automatic flushing urinal (100) of claim 1, wherein the first pre-determined period is a fixed value of 10 seconds, 20 seconds, 30 seconds, 1 minute or 2 minutes.

4. The automatic flushing urinal (100) of claim 1, wherein the pre-determined period is a variable value determined by the time of the urine flow that the urine flow sensor (150) detected.

5. The automatic flushing urinal (100) of claim 1, wherein the hand washing sink (120) further comprises a hand soap dispenser (140) to dispense hand soap.

6. The automatic flushing urinal (100) of claim 1, wherein the hand washing sink (120) further comprises a secondary sensor (160), wherein the secondary sensor (160) is operatively connected to the controller (180) and the timer (185), wherein the secondary sensor (160) gets activated when it detects hand motion and sends a sixth signal to the controller (180); whereupon receiving the sixth signal, the controller (180) sends a seventh signal to the water valve (172) to allow water flow from the water supply (170) through the water valve (172) and water spout (130); whereupon receiving the sixth signal, the controller (180) sends an eighth signal to the timer (185) to start time counting, the timer (185) sends back to the controller (180) a ninth signal after a second predetermined period; whereupon receiving the ninth signal, the controller (180) sends a tenth signal to the water valve (172) to close the valve and stop water flow.

7. The automatic flushing urinal (100) of claim 6, wherein the secondary sensor (160) is a passive infrared sensor to detect hand motion.

8. The automatic flushing urinal (100) of claim 6, wherein the second pre-determined period is a fixed value of 10 seconds, 20 seconds, 30 seconds, 1 minute or 2 minutes.

* * * * *